US008834185B2

(12) United States Patent
Wu

(10) Patent No.: US 8,834,185 B2
(45) Date of Patent: Sep. 16, 2014

(54) ELECTRICAL CONNECTOR ASSEMBLY WITH COMPACT CONFIGURATION

(71) Applicant: Hon Hai Precision Industry Co., Ltd., New Taipei (TW)

(72) Inventor: Jerry Wu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 14 days.

(21) Appl. No.: 13/651,081

(22) Filed: Oct. 12, 2012

(65) Prior Publication Data

US 2013/0095676 A1 Apr. 18, 2013

(30) Foreign Application Priority Data

Oct. 12, 2011 (CN) ..... 2011 1 0307764

(51) Int. Cl.
*H01R 13/62* (2006.01)

(52) U.S. Cl.
USPC ..... 439/76.1

(58) Field of Classification Search
USPC ..... 439/607.04, 607.01, 76.1, 607.35, 701
See application file for complete search history.

(56) References Cited

U.S. PATENT DOCUMENTS

| | | | | |
|---|---|---|---|---|
| 7,303,438 | B2 | 12/2007 | Dawiedczyk et al. | |
| 7,344,409 | B2 * | 3/2008 | Lang et al. | 439/607.04 |
| 7,445,503 | B1 * | 11/2008 | Zhang | 439/607.01 |
| 7,491,089 | B2 * | 2/2009 | Lang et al. | 439/607.01 |
| 7,581,978 | B1 | 9/2009 | Briant | |
| 7,601,010 | B1 * | 10/2009 | Wu | 439/76.1 |
| 7,632,146 | B2 * | 12/2009 | Murphy et al. | 439/607.35 |
| 7,798,821 | B2 * | 9/2010 | Liu et al. | 439/76.1 |
| 7,878,865 | B2 * | 2/2011 | Desrosiers et al. | 439/680 |
| 7,891,986 | B2 * | 2/2011 | Wu | 439/76.1 |
| 7,892,045 | B2 * | 2/2011 | Ratzlaff et al. | 439/701 |
| 7,896,683 | B1 * | 3/2011 | Ratzlaff et al. | 439/374 |
| 7,909,661 | B2 * | 3/2011 | Wu | 439/701 |
| 7,927,150 | B2 * | 4/2011 | Ratzlaff | 439/655 |
| 7,997,909 | B2 * | 8/2011 | Xu et al. | 439/76.1 |
| 7,997,922 | B2 * | 8/2011 | Dawiedczyk et al. | 439/357 |
| 8,011,948 | B2 * | 9/2011 | Wu | 439/358 |
| 8,062,052 | B2 * | 11/2011 | Wu | 439/352 |
| 8,147,255 | B2 * | 4/2012 | Wu | 439/76.1 |
| 8,162,687 | B2 * | 4/2012 | Dawiedczyk et al. | 439/357 |
| 8,267,718 | B2 * | 9/2012 | Straka et al. | 439/497 |
| RE43,780 | E * | 10/2012 | Kubota et al. | 439/677 |
| 8,292,637 | B2 * | 10/2012 | Wu | 439/76.1 |
| RE43,796 | E * | 11/2012 | Kubota et al. | 439/677 |
| 8,376,780 | B2 * | 2/2013 | Dorscht et al. | 439/607.53 |
| 8,439,706 | B2 * | 5/2013 | Sytsma et al. | 439/607.46 |
| 8,523,598 | B2 * | 9/2013 | Wu | 439/358 |

FOREIGN PATENT DOCUMENTS

| | | |
|---|---|---|
| CN | 201142450 | 10/2008 |
| CN | 102148460 | 8/2011 |

* cited by examiner

*Primary Examiner* — Alexander Gilman
(74) *Attorney, Agent, or Firm* — Wei Te Chung; Ming Chieh Chang

(57) ABSTRACT

An electrical connector assembly comprises: an insulative housing defining a receiving space therein communicated with an exterior along a longitudinal direction. The insulative housing defines a resilient latch mechanism integrally formed on a top surface thereof and a pair of projecting portions located at two opposite sides of the latch mechanism for preventing a rotational movement with respect to a complementary mating connector. Two printed circuit board (PCB) modules are arranged in substantially a stacked manner and received into the receiving space. And, a retainer fixes the two PCB modules to the insulative housing.

19 Claims, 9 Drawing Sheets

ELECTRICAL CONNECTOR ASSEMBLY WITH COMPACT CONFIGURATION

FIELD OF THE INVENTION

The present invention generally relates to connectors suitable for transmitting data, more specifically to input/output (I/O) connectors with high-density configuration and high data transmitting rate.

DESCRIPTION OF PRIOR ART

Communication devices, such as severs, routers, etc., have a development trend toward miniaturization. Thus, the internal room of a communication device will be getting smaller. Generally, traditional I/O connector has a large width. These I/O connectors disposed on a printed circuit board (PCB) card of the communication device will occupy more space such that the number of I/O connectors that may be disposed on the PCB card will be decreased.

Additionally, Mini SAS connectors are widely used in servers. U.S. Pat. No. 7,303,438 issued to Dawiedczyk et al. on Dec. 4, 2007 discloses a Mini SAS connector comprising an insulative housing with a metallic latch assembled to a top surface thereof, a printed circuit board disposed in the insulative housing, and a plurality of cables extending into the insulative housing and electrically connected with the printed circuit board. A physical channel rate of the Mini SAS connector has reached 3 Gbps. However, such data transmitting rate might not meet more and more higher data transmitting rate requirements of the server. Furthermore, the metallic latch has a complicated structure and cannot be easily assembled to the housing.

An improved electrical connector overcoming shortages of existing technology is needed.

SUMMARY OF THE INVENTION

Accordingly, an object of the present invention is to provide an electrical connector assembly having high-density configuration, high data transmitting rate, and a simple latch mechanism.

In order to achieve the above-mentioned object, an electrical connector assembly comprises: an insulative housing defining a receiving space therein communicated with an exterior along a longitudinal direction, the insulative housing having a resilient latch mechanism integrally formed on a top surface thereof and a pair of projecting portions located at two opposite sides of the latch mechanism for preventing a rotational movement with respect to a complementary mating connector; two printed circuit board (PCB) modules arranged in substantially a stacked manner and received into the receiving space; and a retainer fixing the two PCB modules to the insulative housing.

Other objects, features and advantages of the invention will be apparent from the following detailed description taken in connection with the accompanying drawings.

DETAILED DESCRIPTION OF PREFERRED EMBODIMENTS

Figure 1:
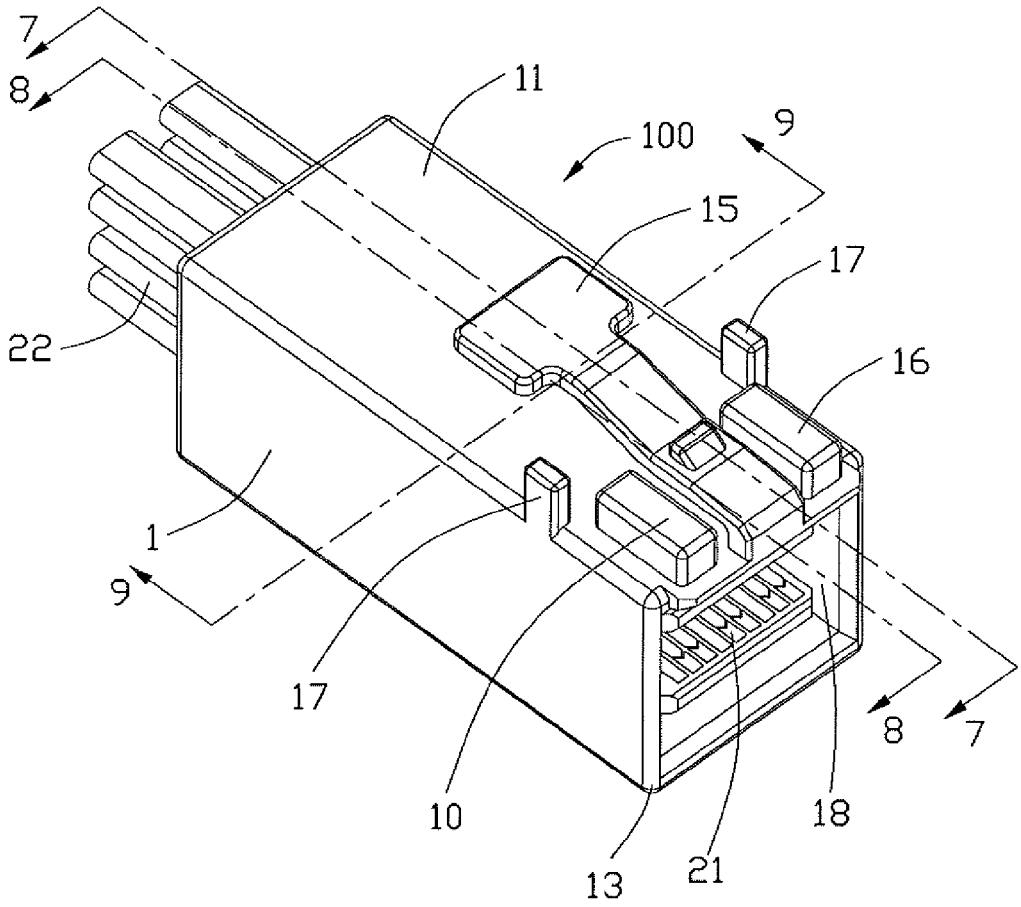
FIG. 1 is a perspective view of an electrical connector assembly in accordance with the present invention.

Reference will now be made to the drawing figures to describe the present invention in detail.

Figure 2:
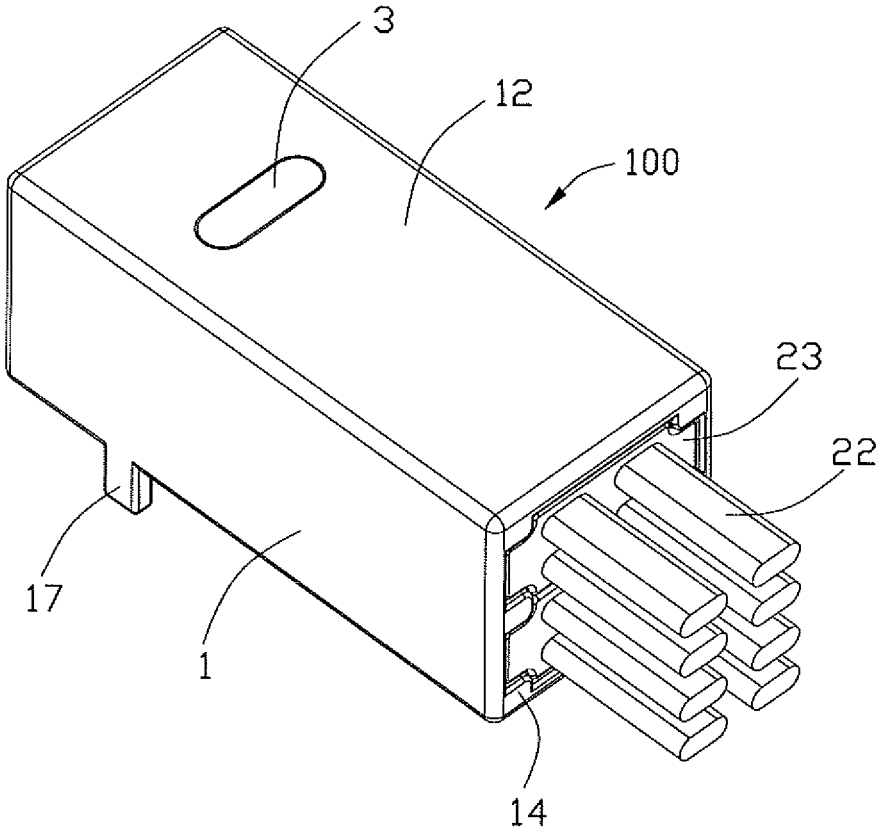
FIG. 2 is another perspective view of the electrical connector assembly of FIG. 1.
Figure 3:
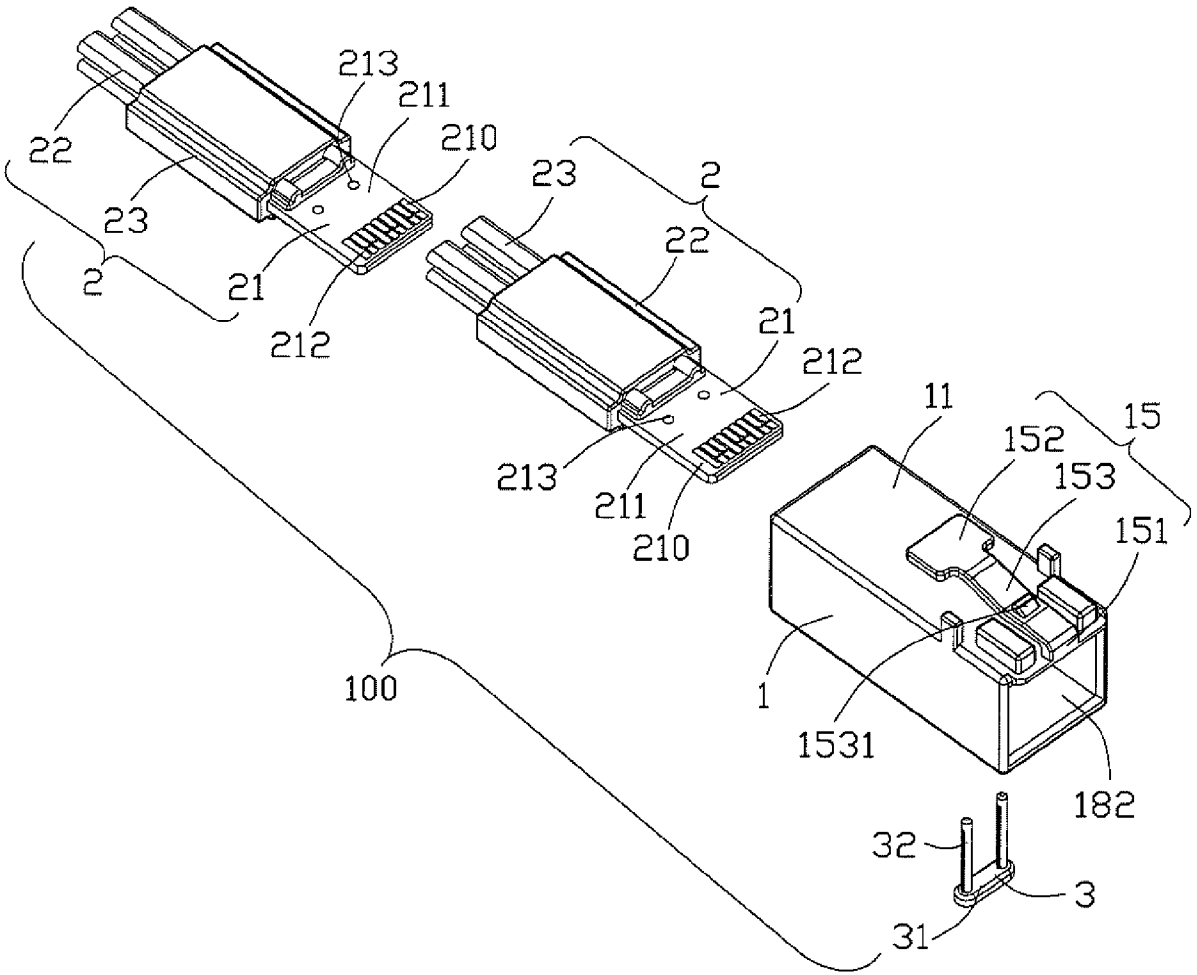
FIG. 3 is an exploded, perspective view of the electrical connector assembly of FIG. 1.

FIGS. 1 and 2 illustrate perspective views of an electrical connector assembly 100 made in accordance with the present invention. Referring to FIGS. 3 to 6 in conjunction with FIG. 8, the electrical connector assembly 100 comprises a box-shape insulative housing 1, two stacked PCB modules 2 disposed in the insulative housing 1, and a retainer 3 fixing the two PCB modules 2 to the insulative housing 1.

Referring to FIGS. 1 to 7, the insulative housing 1 defines opposing top surface 11 and bottom surface 12 and opposing front surface 13 and rear surface 14. The insulative housing 1 has a latch mechanism 15 unitary formed on the top surface 11, a pair of projecting portions 16 formed on the top surface 11 and located at two opposite sides of the latch mechanism 15, and a pair of protrusions 17 formed on two sides of the top surface 11 and located rearwardly of the pair of projecting portions 16. The pair of projecting portions 16 are used for preventing rotational movement when the electrical connector assembly 100 mates with a complementary connector (not shown). The pair of protrusions 17 are used for preventing the electrical connector assembly 100 from excessive insertion into the complementary connector (not shown).

Referring to FIGS. 1, 3, 5, and 7, the latch mechanism 15 is cantilevered to the top surface 11 of the insulative housing 1 and defines a front connecting section 151 connecting to a front end of the top surface 11 of the insulative housing 1 and a rear pressing section 152 paralleled and spaced apart to the top surface 11 of the insulative housing 1 and a latching section 153 connected with the front connecting section 151 and the rear pressing section 152. The latching section 153 defines an engagement member 1531 formed on a top surface thereof. When the pressing section 152 is pressed by an operator, the latching section 153 is also moved downwardly. When the pressing section 152 is released by the operator, the latching section 153 is resumed to an original state. The electrical connector assembly 100 is engaged with and discrete from the complementary connector (not shown) through operating the latch mechanism 15.

Referring to FIGS. 1 to 9, the insulative housing 1 defines a receiving space 18 extending along a longitudinal direction from the front surface 13 to the rear surface 14. The insulative housing 1 further defines a partition 181 formed in the receiving space 18 and dividing the receiving space 18 into a front receiving room 182 and a rear receiving room 183 in a front to rear direction. The front receiving room 182 can be defined as a mating port of the insulative housing 1. A pair of ribs 184 are formed at two inner side surfaces of the rear receiving room 183 for supporting the two PCB modules 2 along a vertical direction. And, a profile of the inner surface of the rear receiving room 182 tightly fit with a profile of two stacked PCB modules 2. The partition 181 defines two paralleled slots 185 extending from a front surface to a rear surface thereof and communicating the front receiving room 182 to the rear receiving room 183. In addition, the insulative housing 1 defines a recess 121 formed on a bottom surface 12 thereof and in alignment with the partition 181 along a vertical direction. The partition 181 defines a pair of vertical receiving holes 186 arranged along a transverse direction and extending downwardly and communicated with the recess 121. Two receiving holes 186 are respectively crossed with two paralleled slots 151.

Referring to FIGS. 3 to 8, two PCB modules 2 are structured same with each other. Each PCB module 2 comprises a printed circuit board 21, four cables 22 electrically connected with the printed circuit board 21 and an insulator 23 over-molding around a front end of the cables 22 and a rear end of the printed circuit board 21 for protecting a connection between the printed circuit board 21 and four cables 22. The printed circuit board 21 defines a mating section 210, a connecting section 211 disposed in back of the mating section 210 and a soldering section (not figured) electrically connected with the cables 22. The mating section 210 defines a plurality of conductive pads 212 formed on two opposite upper and lower surfaces and arranged along a widthwise direction. The connecting section 211 defines two positioning holes 213 spaced apart with each other and arranged along a widthwise direction. The mating section 210 of the printed circuit board 21 of the PCB module 2 is passed through the slot 185 and entered into the front receiving room 182 of the insulative housing 1. And, the insulator 23 is received into the rear receiving room 183 of the insulative housing 1.

Figure 4:
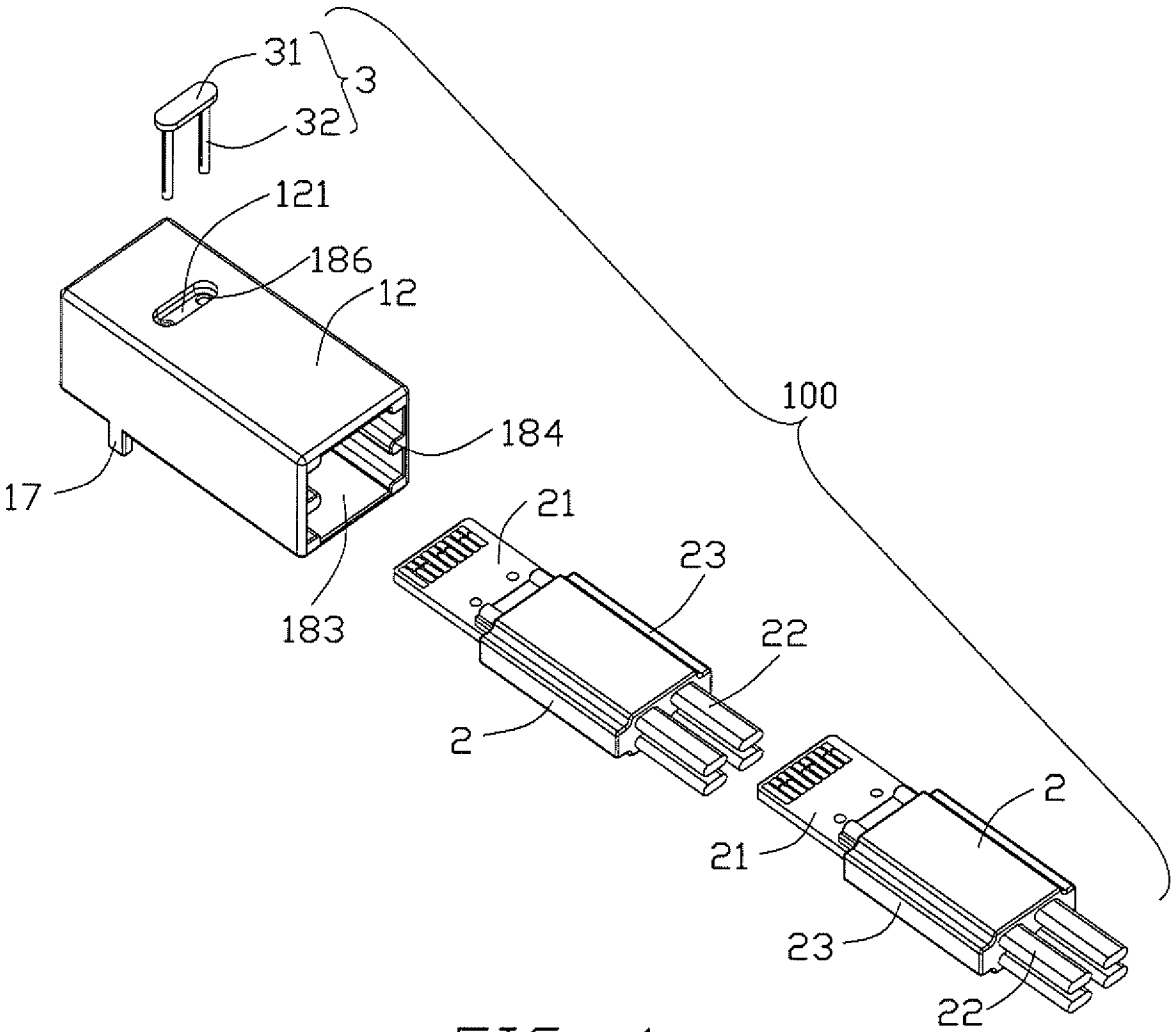
FIG. 4 is an exploded, perspective view of the electrical connector assembly of FIG. 2.
Figure 5:
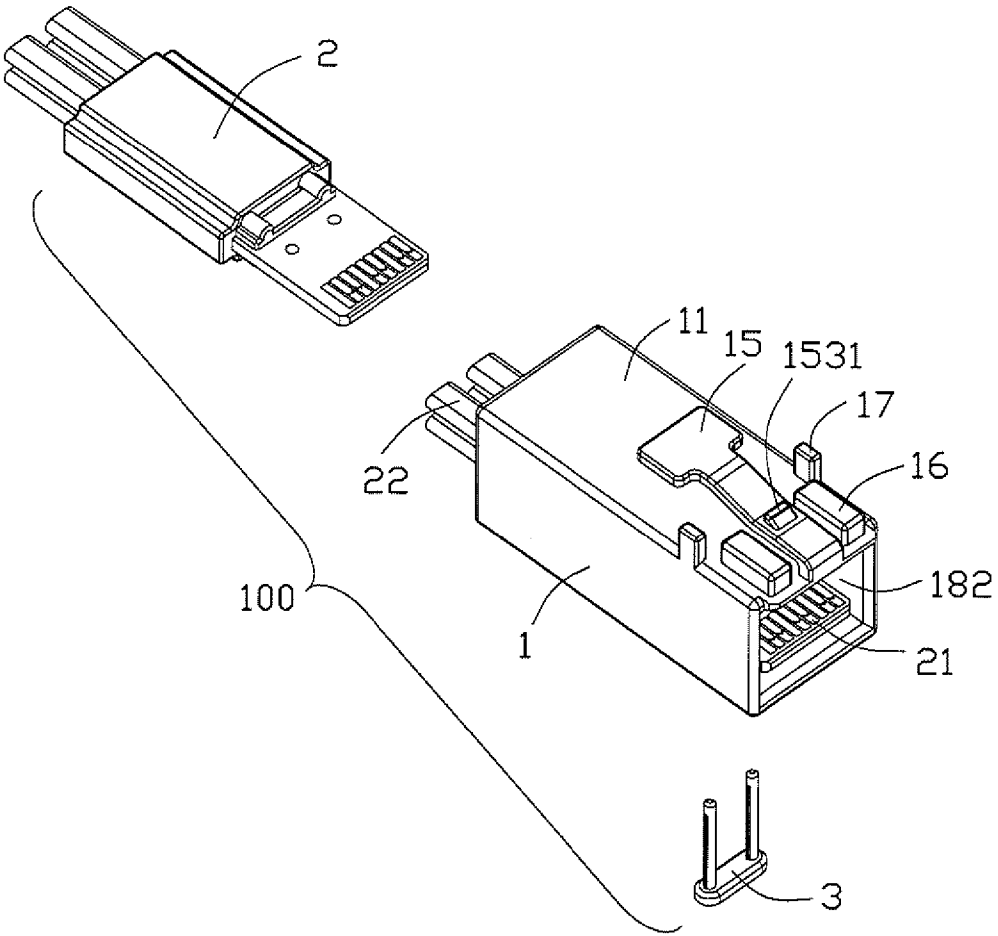
FIG. 5 is a partially assembled view of the electrical connector assembly of FIG. 1.
Figure 6:
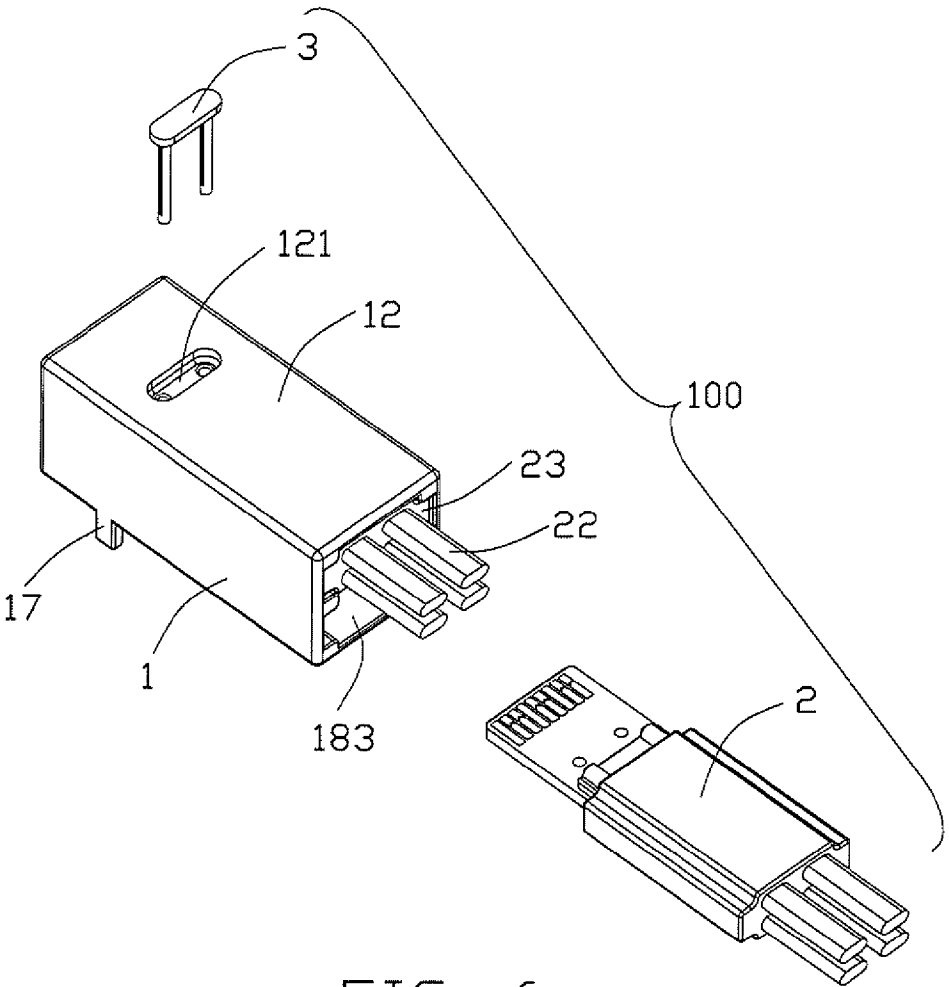
FIG. 6 is a partially assembled view of the electrical connector assembly of FIG. 2.
Figure 7:
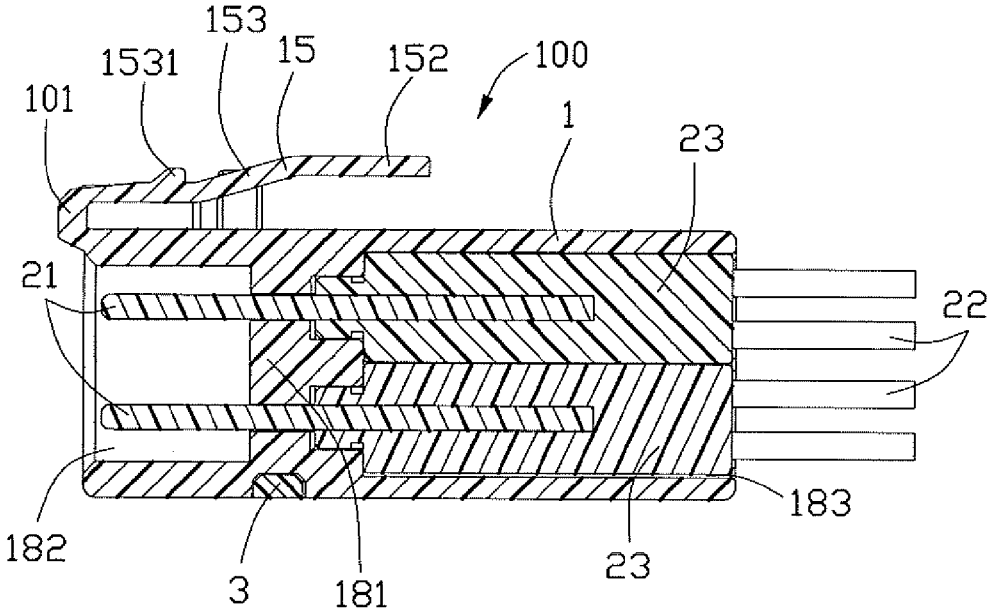
FIG. 7 is a cross section view of the electrical connector assembly of FIG. 1 taken along line 7-7.
Figure 8:
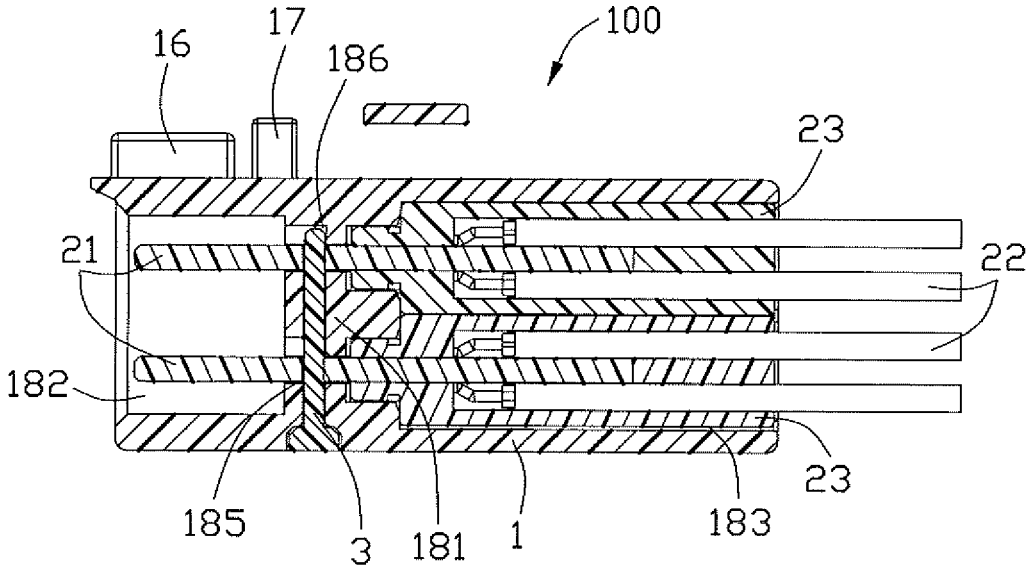
FIG. 8 is a cross section view of the electrical connector assembly of FIG. 1 taken along line 8-8.
Figure 9:
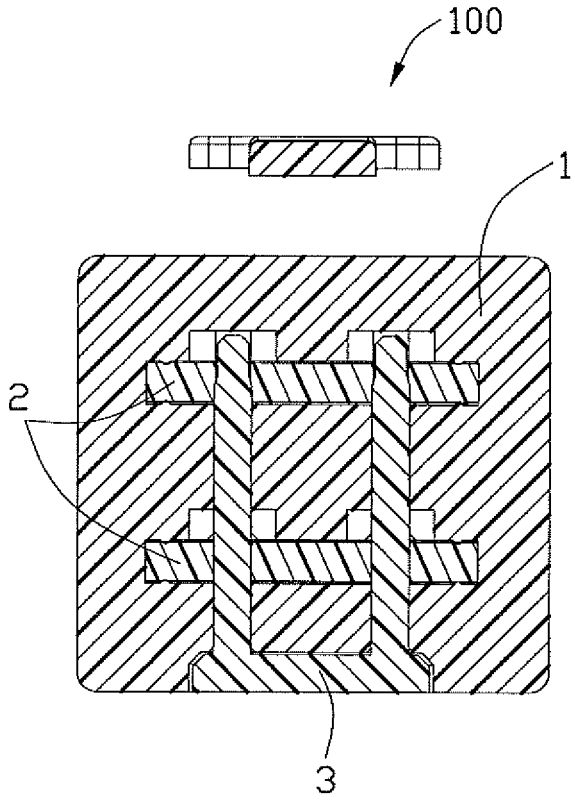
FIG. 9 is a cross section view of the electrical connector assembly of FIG. 1 taken along line 9-9.

Referring to FIGS. 4 to 6 and in conjunction with FIGS. 8 to 9, the retainer 3 is made of insulative material and has a base portion 31 and a pair of positioning posts 32 extending from a top surface thereof for a distance.

Referring to FIGS. 1 to 9, the assembling process of the electrical connector assembly 1 made in according to the present invention starts from assembling the two PCB modules 2 into the receiving space 18 of the insulative housing 1 along a rear to front direction. The two PCB modules 2 are arranged in a stacked manner when the two PCB modules 2 are fully received into the receiving space 18. The two PCB modules 2 have corresponding rear portions directly touching each other. And, the mating sections 210 of the two printed circuit boards 21 are passed through two slots 185 of the partition 181 and received into the front receiving room 182. The two insulators 23 are filled in the rear receiving room 183. The positioning holes 213 of the two printed circuit boards 21 are in alignment with two receiving holes 186 along a vertical direction.

After the two PCB modules 2 are received into the receiving space 18 of the insulative housing 1, then assembling the retainer 3 to the bottom surface 12 of insulative housing 1. The pair of positioning posts 32 are received into the receiving holes 186 of the partition 181 in a down to up direction and passed through the positioning holes 213 of the two printed circuit boards 21. Thus, the retainer 3 is interfered with the two PCB modules 2. The base portion 31 of the retainer 3 is received into the recess 121. Thus, two stacked PCB modules 2 are firmly positioned to the housing 1 through the retainer 3.

After the above assembling steps, the entire process of assembling of the electrical connector assembly 100 is finished. The electrical connector assembly 100 has a new mating surface to meet higher and higher data transmitting rate. In addition, the electrical connector assembly 100 has a narrow and lower profile. Thus, the complementary connector (not shown) for mating with the electrical connector assembly 100 will also occupy little space to meet the miniaturization of the communication device. And, the electrical connector assembly 100 has a simple latch mechanism 15 which is easily operated to achieve an engagement and disengagement between the electrical connector assembly 100 and the complementary connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly comprising:

an insulative housing defining a receiving space therein communicated with an exterior along a longitudinal direction, the insulative housing having a resilient latch mechanism and a pair of projecting portions integrally formed on a top surface thereof, and the pair of projecting portions located at two opposite sides of the latch mechanism for preventing a rotational movement with respect to a complementary mating connector;

two printed circuit board (PCB) modules arranged in substantially a stacked manner and received into the receiving space; and a retainer fixing the two PCB modules to the insulative housing.

2. The electrical connector assembly as recited in claim 1, wherein the insulative housing has a partition formed in the receiving space and dividing the receiving space into a front receiving room and a rear receiving room, each PCB module defines a mating section at a front end thereof passing through the partition and received into the front receiving room, and the two mating sections of the two PCB modules are spaced apart from each other along a vertical direction.

3. The electrical connector assembly as recited in claim 1, wherein the latch mechanism is cantilevered to the top surface of the insualtive housing.

4. The electrical connector assembly as recited in claim 1, wherein the latch mechanism defines a front connecting section connecting to a front end of the top surface of the insulative housing and a rear pressing section paralleled and spaced apart from the top surface of the insulative housing, and a latching section connected with the front connecting section and the rear pressing section.

5. The electrical connector assembly as recited in claim 4, wherein the latching section defines an engagement member formed on a top surface thereof.

6. The electrical connector assembly as recited in claim 1, wherein each PCB module has a printed circuit board, a plurality of cables electrically connected to the printed circuit board, and an insulator over-molding around a rear end of the printed circuit board and a front end of the plurality of cables, and the mating section is formed on a front end of the printed circuit board.

7. The electrical connector assembly as recited in claim 6, wherein the two insulators of the two PCB modules are filled into the rear receiving room, and the plurality of cables of the two PCB modules extend rearwardly out of the insulative housing.

8. The electrical connector assembly as recited in claim 1, wherein the insulative housing comprises a pair of protrusions formed on two lateral sides of the housing top surface and located in back of the pair of projecting portions for preventing excessive insertion of the insulative housing into the complementary connector.

9. The electrical connector assembly as claimed in claim 1, wherein the two PCB modules have respective rear portions directly touching each other.

10. An electrical connector assembly comprising:

a housing defining a partition, a front receiving room and a rear receiving room spaced apart by the partition, and a latch mechanism integrally formed on a top surface thereof;

two paralleled printed circuit boards disposed in the housing, each of the two printed circuit boards having a mating section passing through the partition and received in the front receiving room; and a plurality of cables electrically connected to respective rear ends of the two printed circuit boards and extending out of the housing;

wherein the insulative housing defines a pair of projecting portions located at two opposite sides of the latch mechanism for preventing a rotational movement with respect to a complementary mating connector.

11. The electrical connector assembly as recited in claim 10, wherein two insulators are respectively formed on a junction between the printed circuit boards and the cables, the two insulators filled into the rear receiving room.

12. The electrical connector assembly as recited in claim 10, further comprising a retainer fastening the two printed circuit boards to the insulative housing.

13. The electrical connector assembly as recited in claim 12, wherein the retainer is received into the partition, and the retainer has two positioning posts extending through the two printed circuited boards.

14. The electrical connector assembly as recited in claim 10, wherein the housing further defines a pair of protrusions formed on two lateral sides of the top surface and located in back of the pair of projecting portions for preventing the housing from excessively inserting into the complementary connector.

15. An electrical connector assembly comprising:

an insulative housing defining therein a receiving space forwardly communicating with an exterior along a front-to-back direction, the insulative housing being equipped with a resilient latch mechanism on one surface thereof;

two printed circuit board (PCB) modules arranged in substantially a stacked manner and received into the receiving space; and a retainer being of a U-shaped configuration and defining unitarily a horizontal base portion with two downwardly extending positioning posts spaced from each other in a transverse direction perpendicular to said front-to-back direction and inserted into the housing in a vertical direction perpendicular to both said front-to-back direction and said transverse direction to secure the two printed circuit boards and the housing together; wherein the housing defines a recess and a pair of vertical receiving holes communicating with the recess, the base portion being received in the recess and the positioning posts being received in the corresponding vertical receiving holes, respectively.

16. The electrical connector assembly as claimed in claim 15, further including a plurality of cables connected to two opposite surfaces a rear end region of each of said two printed circuit boards.

17. The electrical connector assembly as claimed in claim 16, wherein more then one cables are connected to each surface of each of said two printed circuit boards.

18. The electrical connector assembly as claimed in claim 15, wherein the retainer and the latch are exposed upon two opposite surfaces of the housing.

19. The electrical connector assembly as claimed in claim 15, wherein the insulative housing defines a pair of projecting portions located at two opposite sides of the latch mechanism for preventing a rotational movement with respect to a complementary mating connector.

* * * * *